US007121549B2

(12) United States Patent
Levine

(10) Patent No.: US 7,121,549 B2
(45) Date of Patent: Oct. 17, 2006

(54) WORLD GEOGRAPHY AND CULTURE BASED GAME AND METHOD

(76) Inventor: Howard N. Levine, 6285 NW. 107 Ter., Parkland, FL (US) 33076

( * ) Notice: Subject to any disclaimer, the term of this patent is extended or adjusted under 35 U.S.C. 154(b) by 0 days.

(21) Appl. No.: 10/778,256

(22) Filed: Feb. 13, 2004

(65) Prior Publication Data

US 2004/0160004 A1 Aug. 19, 2004

Related U.S. Application Data

(60) Provisional application No. 60/447,770, filed on Feb. 14, 2003.

(51) Int. Cl.
*A63F 3/00* (2006.01)

(52) U.S. Cl. ..... 273/254; 273/430

(58) Field of Classification Search ..... 273/254, 273/430, 431

See application file for complete search history.

(56) References Cited

U.S. PATENT DOCUMENTS

| | | | | |
|---|---|---|---|---|
| 3,883,142 | A | 5/1975 | Spohn | |
| 4,052,072 | A | 10/1977 | Beal | |
| 4,095,800 | A | 6/1978 | Konsolas | |
| 4,635,939 | A | 1/1987 | Makow | |
| 4,784,394 | A | 11/1988 | Sumin | |
| 4,928,967 | A | 5/1990 | Woodliff | |
| 4,961,582 | A | 10/1990 | Van Lysel | |
| 5,013,048 | A | 5/1991 | Turner | |
| 5,257,939 | A | 11/1993 | Robinson | |
| 6,102,398 | A | 8/2000 | Kolleth | |
| 6,142,472 | A * | 11/2000 | Kliebisch | 273/236 |

* cited by examiner

*Primary Examiner*—Vishu Mendiratta
(74) *Attorney, Agent, or Firm*—David P. Lhota, Esq.; Stearns Weaver Miller Weissler Alhadeff & Sitterson, P.A.

(57) ABSTRACT

A game comprising a mechanical or electronic based game board having a continental world map thereon, plurality of different colored passport cards (one for each player), plurality of different colored game pieces, plurality of question cards, plurality of cultural situation based cards, die with six sides, answer cards denoted with an "A," "B" or "C," passport stamps, scoring chart and scoring pads. Each question card has a question and answer on one side and the corresponding answer and question, respectively, on the opposite side. The answer cards comprise a plurality of cards having either an "A," "B" or "C". The cultural situation based cards have a hypothetical cultural situation and response, and instructions to the player based on how the hypothetical person responded to the cultural situation. The game board includes a map showing all the continents and two or more intersecting closed-loop paths with question, culture or airport spaces. Each player answers the question drawn when a player lands on a question space or follows the instructions on a drawn culture card when a player lands on a culture space. The passport card is used to collect passport stamps when the player correctly answers a question or is instructed to collect a stamp. The first player to collect all the required stamps or to obtain the highest cultural intelligence score at the end of the game is the winner.

13 Claims, 9 Drawing Sheets

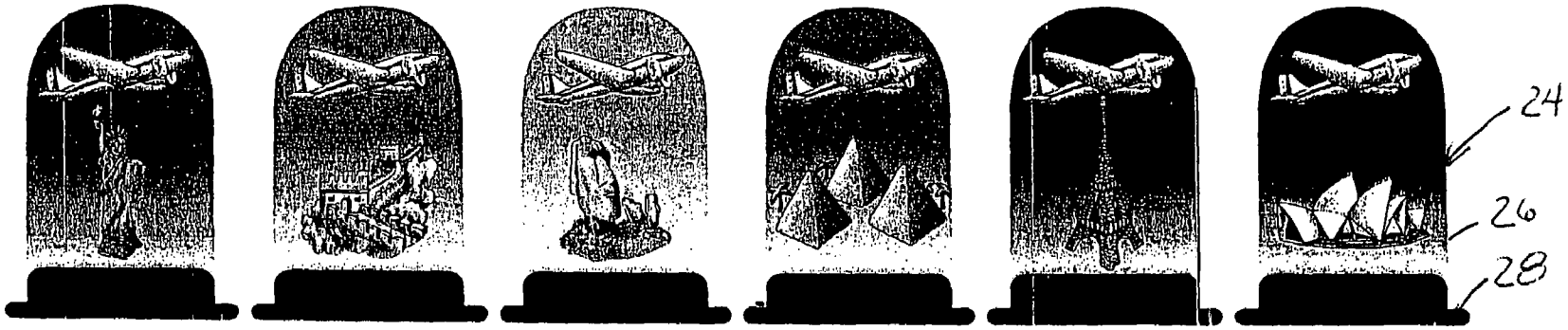
Passport to Culture
Playing Pieces (Pawns) • Insert Piece 1" x 1-5/8"
Option 2A • 11/25
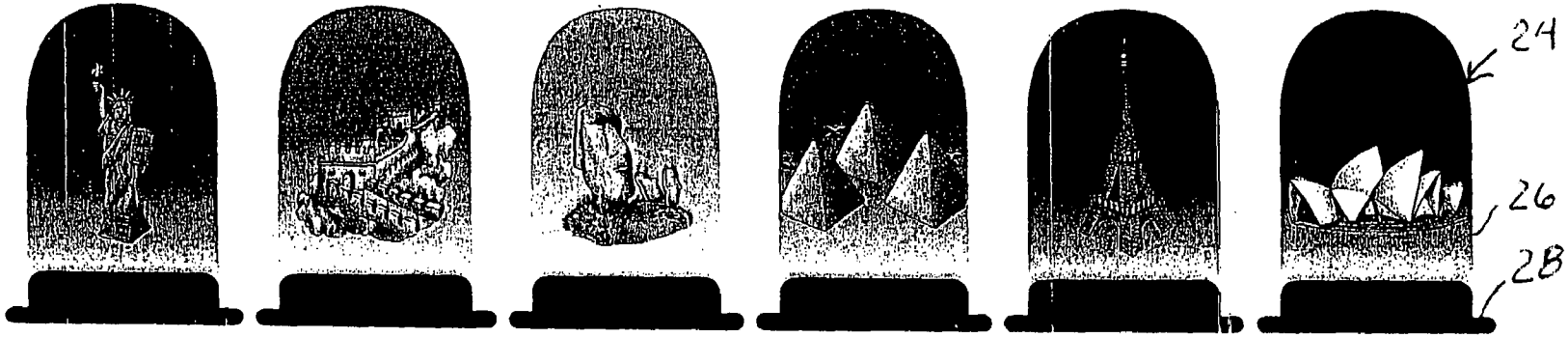
Passport to Culture
Playing Pieces (Pawns) • Insert Piece 1" x 1-5/8"
Option 2B • 11/25
FIG. 3

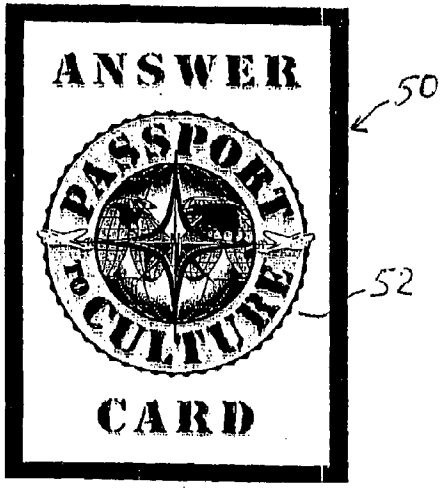
FIG. 4
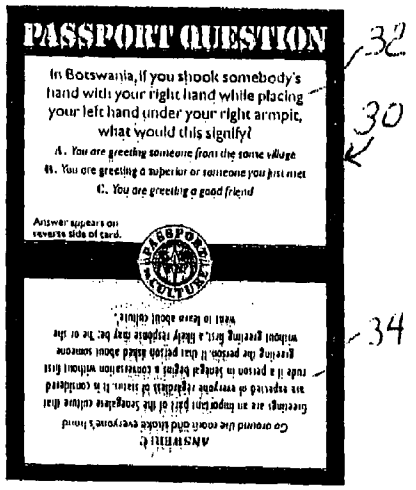
FIG. 5
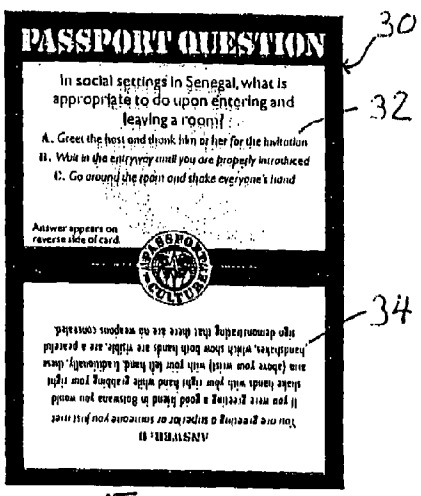
FIG. 6
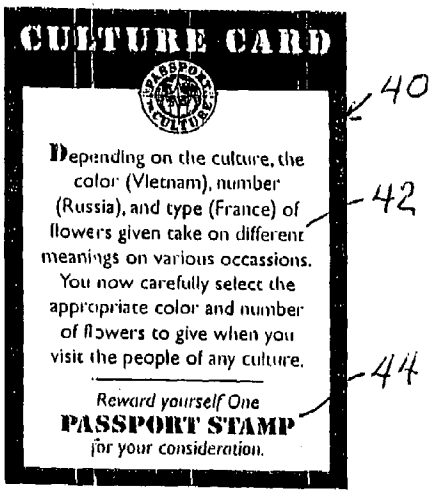
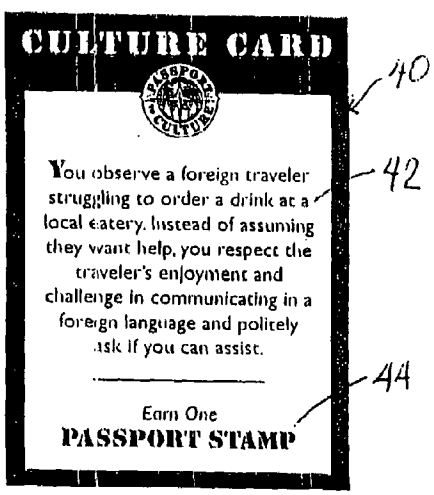
FIG. 6

70

FIG. 10

PASSPORT TO CULTURE™

OBJECTIVE

Grab your *Passport to Culture*™.. let's go continent hopping. With a desire for discovery, players earn stamps for their passports by traveling the planet and answering fascinating questions about the diverse people and countries of the world.

HOW TO PLAY

*Starting the Game:*
Players select a Passport, a matching colored playing piece, and a set of A, B, and C Answer Cards.

Select one player to record correct answers for all teams on the Correct Answers scorepad.

Position playing pieces at their corresponding color's airport space. (Blue playing piece begins on blue airport space). The player whose birthday is next begins by rolling the die and moving the playing piece. Play proceeds in a clockwise direction.

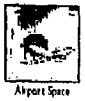
Airport Space

*Moving Around the Board:*
The player whose turn it is rolls the die and moves that number of spaces, following the direction of the arrows. (More than one player may occupy the same space on the board.)

When players reach any of the 4 points where paths intersect, they have the option of following the direction of either path.

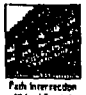
Path Intersection (Cultural Crossing)

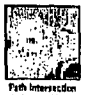
Path Intersection (Culture Card Space)

After moving to a new space, the player then selects the next appropriate Passport Question or Culture Card from the card box.

*Passport Question Card (Stamp) Space:*
The player reads only the question and answer choices aloud. All players (including the reader) answer the question by placing their A, B, or C Answer Card face down in front of them. After all selections are made, the answer and follow-up facts are read aloud from the back of the card. These not only provide interesting information, but may also give clues or answers to other questions.

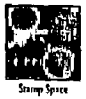
Stamp Space

Players reveal their answer selections. All players who answer correctly earn a Passport Stamp corresponding to the color landed on.

- If the space corresponds to more than one color, either of those stamps may be selected.
- A World Stamp may be substituted if players don't need that color's stamp.
- If players already have both the color and World Stamps, no other passport stamps are awarded for that turn.

The scorekeeper marks the scorepad to record correct answers.

Place the Passport Question card in a discard pile (to be used to determine CQ™ scores when the game ends*).

*Culture Card Space:*
The player who landed selects a Culture Card and reads it aloud. (Unlike the question cards, culture cards only apply to the player who landed on the space). After the card is read, place it in the back of its box.

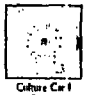
Culture Card Space

*Airport Space:*
During game play, when landed on after a die roll, the player may choose either to stay at that airport where he/she just landed or to fly directly to any other airport. After this selection is made, read the next Passport Question card.

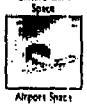
Airport Space

*Ending the Game:*
The first player to collect the 10 stamps that complete his/her Passport wins. However, a different player may also share top honors by achieving the highest CQ™ (Cultural IQ™ score).

EXAMPLE OF GAME PLAY

Player #1 rolls a five and moves his/her piece, landing on a blue/orange space.

Player #1 selects the next Passport Question card from the box and reads the question and answer choices aloud.

All players choose an answer by placing their A, B, or C Answer Card face down in front of them. Once everyone makes a selection, Player #1 reads the answer and follow-up facts aloud.

Players reveal their answer selection. All players who answered correctly earn either a blue or orange Passport Stamp. If a player has already collected the blue or orange Passport Stamp, a World Stamp may be substituted. If a player doesn't need any of the possible stamps for that space, then no stamp is awarded.

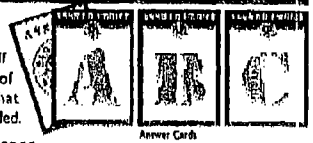
Answer Cards

The designated scorekeeper should record all correct answers on the Correct Answers scorepad.

Place the Passport Question card in a discard pile for later CQ™ scoring.

* Cultural IQ™ (CQ™) is explained on Side 2

WORLD GEOGRAPHY AND CULTURE BASED GAME AND METHOD

CROSS REFERENCE TO RELATED APPLICATIONS

This application claims the benefit of provisional patent application Ser. No. 60/447,770 filed Feb. 14, 2003.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention generally relates to a game, and more particularly, to a culture based game that educates its players on geography and the various cultures around the world generally employing question cards with culture and, or geography oriented questions and answers, cards with hypothetical cultural situations and directions, color coded map of the world, passports and passport stamps.

2. Description of Related Art

Educational games, such as those marketed under the trademarks, Scrabble, Trivial Pursuit and Risk, are known in the art. The prior art also comprises games that employ question and answer cards that require players to guess how another player would respond to a question, such as the one marketed under the name Scruples. However, no games are known that teach about various world cultures and geographies, as contemplated by the instant invention. For instance, U.S. Pat. No. 5,257,939, issued to Robinson, et al., discloses a cultural knowledge board game having a plurality of playing cards and playing tokens. Each playing space is assigned to a participant and has disposed thereon a plurality of distinct educational categories. Each playing card has a plurality of topics corresponding to an educational category. The playing tokens are assigned to each participant and are equal in number to the number of educational categories on each playing space. The game, however, fails to adequately focus on various world cultures and customs, does not evoke player participation on virtually every turn, does not give clues in advance and does not comprise a game system incorporating passports to simulate the feel of travel.

Other patents known in the prior art are as follows. U.S. Pat. No. 3,883,142, issued to Spohn, provides a board game apparatus for simulating a tour comprising a playing surface having a plurality of spaces representing places and clusters of places, for example, places of interest to sightseers that are connected by differently colored or shaded lines representing avenues of travel and other lines representing transportation systems. The game includes sets of cards to represent the indicated places, and dice of different colors corresponding to the lines to indicate the mode and extent of movement of game pieces permissible along the avenues of travel. Barricades are also included for interrupting travel between places when placed on the playing surface by a player instructed to do so.

U.S. Pat. No. 4,052,072, issued to Beal, discloses an educational world map game adapted to be played on a pachisi-like game playing board bearing the world continental areas with countries marked off and lines of playing spaces traversed by playing pieces that are counted off according to the number on the roll of the dice and directed by drawn cards or playing pieces corresponding to continental areas.

U.S. Pat. No. 4,095,800, issued to Konsolas, discloses a map board game apparatus having a map including a plurality of selected countries, each distinguishable from the others by the color thereof. A path is superimposed on the game board map and includes a plurality of stopping points in each country corresponding to the capital city of the country. A selector is included for effecting movement of the game members along the path and includes a base and a pointer rotatably mounted thereon wherein the base has an inter-radial band divided into the plurality of selectable segments, each having indicia thereon for instructing the movement of a game member a number of points along the path, and an outer radial band concentric with the inner band having indicia thereon associated with different countries for instructing the movement of game members to a stopping point in the country associated therewith.

U.S. Pat. No. 4,784,394, issued to Sumin, discloses a tourist game apparatus designed to guide and educate players about geography, transportation, history, entertainment and amusement interests in combination with shopping, restaurants and hotels. The game apparatus includes a board comprising of at least one map bearing the geographical indicia characterizing the area. A plurality of playing cards includes information about these geographical locations which are connected on the map by separate travel itineraries. Each player plays the game by receiving an individual itinerary and performing a trip according to existing means of transportation and distances within the area.

U.S. Pat. No. 4,928,967, issued to Woodliff, discloses a map board game featuring an actual map of the world with an outer border in colors corresponding to the colors of specific regions. Players move from region to region around the world by traveling around the outer border or by choosing a transportation card which allows for movement into certain regions. Players can purchase businesses and accumulate world market currency in the different regions by answering questions correctly specific to that region. The winner is the player who owns all the businesses of the world or who acquires most world market currency.

U.S. Pat. No. 4,961,582, issued to Van Lysel, discloses a geographical travel game including a playing board with a large map of Western Europe bordered by 13 blocks that run along the bottom and left hand sides of the playing board. The playing map is divided into 16 European countries and 49 European cities. Players start from the bordering box and play proceeds into any city the player chooses. Once in the city, the player draws a corresponding city card, players move between cities and use money for fees, rewards, and penalties.

U.S. Pat. No. 5,013,048, issued to Turner, discloses a game that simulates world travel, including a board having two zones marked thereon, a plurality of cards and a number of playing pieces. Players score points by moving playing pieces on the first zone, using resources and opportunities represented by cards acquired by movement of a further playing piece in the second zone and an exercise of chance or skill. The game includes identification of the geographical location of a place of tourist significance or other tourist attractions depicted on the face of cards.

While the prior art reveals various games that incorporate geography, none of the above-noted references address an educational game for teaching about various cultures, customs and facts as contemplated by the instant invention. The references found fail to disclose an entertaining game that simultaneously teaches about world geography, cultures, customs and facts. Accordingly, it is our opinion that your invention is patentable over the references found in our search.

BRIEF SUMMARY OF THE INVENTION

In light of the foregoing, it is a primary object of the instant invention to provide a game that facilitates fun while teaching about various cultures and countries around the world.

It is another object of the instant invention to provide a game that combines world geography, culture and fact based questions and issues.

It is also an object of the instant invention to provide a game that requires all players to answer questions so as to involve all players during virtually every move.

It is an additional object of the instant invention to provide a game that teaches about world geography and culture utilizing a game board displaying a map of the world, a plurality of question cards with culture and, or geography based questions and answers, a plurality of cards having hypothetical culture settings and instructions for the player, a six-sided die, a world passport for each player, answer cards and, or a passport stamp.

In light of these and other objects, the instant invention is a game comprising a mechanical or electronic based game board having a continental world map thereon, plurality of different colored passport cards (one for each player), plurality of different colored game pieces, plurality of question cards, plurality of cultural situation based cards, die with six sides, answer cards denoted with an "A," "B" or "C," passport stamps, scoring chart and scoring pads. The color of the game pieces and passports preferably coincide such that the player's selected game piece and passport match. The question cards are preferably marked with "Passport Question™" (a trademark of the Inventor) to indicate that these cards have culture and, or geography based questions and answers. Each question card preferably has a question and answer on one side and the corresponding answer and question, respectively, on the opposite side. The answer cards comprise a plurality of cards having either an "A," "B" or "C," whereby each player gets one of each for answering questions. The cultural situation based cards preferably have a hypothetical cultural situation and response, and instructions to the player based on how the hypothetical person responded to the cultural situation. The cultural situation based cards are preferably marked with "Culture Card™" (a trademark of Inventor). The game board includes a map showing all the continents and two or more intersecting closed-loop paths. The paths are formed by individual spaces superimposed over the continents. The spaces comprise question spaces where a question card is drawn and answered by all players, airport spaces for traveling to other continent airports and "Culture Card™" spaces for drawing, reading and complying with the instructions thereon. Each space has two colors, which are used to determine the correct colored stamp to use when a player answer's a question correctly. The passport card is used to collect passport stamps when the player correctly answers a question. The passport stamps include different colored stamps corresponding to the spaces and a "World Stamp™" (a trademark of Inventor). The scoring pad is used to keep score. The scoring chart comprises a scoring key for determining a player's Cultural Intelligence™ or CQ™ (Cultural Intelligence™ and CQ™ are trademarks of Inventor).

In the preferred embodiment, the object of the game is to be the first player to collect all ten stamps, or some other predetermined number of stamps. When starting the game, the players select a passport card, matching colored playing piece and set of "A," "B" or "C" answer cards. Each player rolls the die in turn during the game to determine the number of spaces to move the playing piece. A rolling tray may be used to avoid influencing the roll. Each time a player lands on a question space, the player draws the top or next question card and reads the question, and all players answer the question by placing either an "A," "B" or "C" answer card. All players that answer correctly earn a stamp corresponding to one of the space colors or a "World Stamp™." If a player lands on a "Culture Card™" space, the player reads the card aloud to share the educational information thereon and to identify the instructions. The instructions on the "Culture Card™" preferably include either awarding or not awarding a stamp. The first player to collect all colored stamps on its card wins.

The game of the instant invention also includes a number of alternative ways to win. In one alternative embodiment, the player who collects the most stamps within a certain time limit wins. In a second embodiment, the first player to correctly answer a specified number of questions wins. In a third embodiment, the first player to receive one stamp of each color wins. In a fourth embodiment, players may be divided up into teams and, or the game may be adapted for educational or classroom purposes.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 3 is an elevational view of the preferred embodiment of the game pieces in accordance with the instant invention.

FIG. 4 is an elevational view of the preferred embodiment of an answer card in accordance with the instant invention.

FIG. 5 is an elevational view of the preferred embodiment of passport question cards in accordance with the instant invention.

FIG. 6 is an elevational view of the preferred embodiment of cultural situation based cards in accordance with the instant invention.

FIG. 10 is an elevational view of the preferred embodiment of the instructions of the culture and geography based game of the instant invention.

DETAILED DESCRIPTION OF THE INVENTION

With reference to the drawings, FIGS. 1–11 depict the preferred embodiments of the instant invention is a game system and method for playing a game which is generally referenced by numeric character 10 and, or as the game. Although the game system 10 is described with reference to a game board, cards, playing pieces and other three-dimensional objects, the method of playing the game 10 may be adapted for play on a computer or other unit having a software processor by converting the game 10 into a software format.

Figure 1:
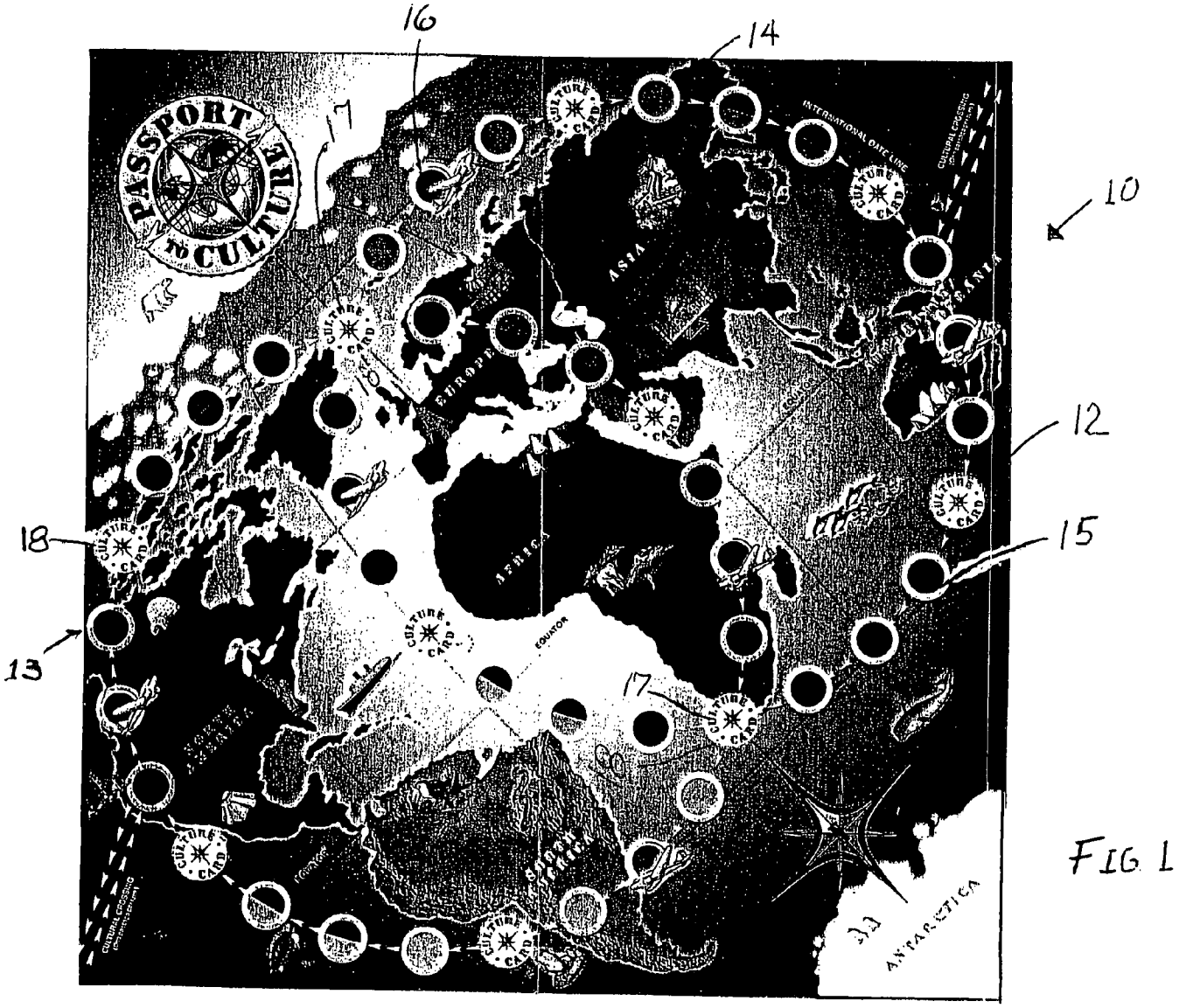
FIG. 1 is a plan view of the preferred embodiment of the game board in accordance with the instant invention.
Figure 11:
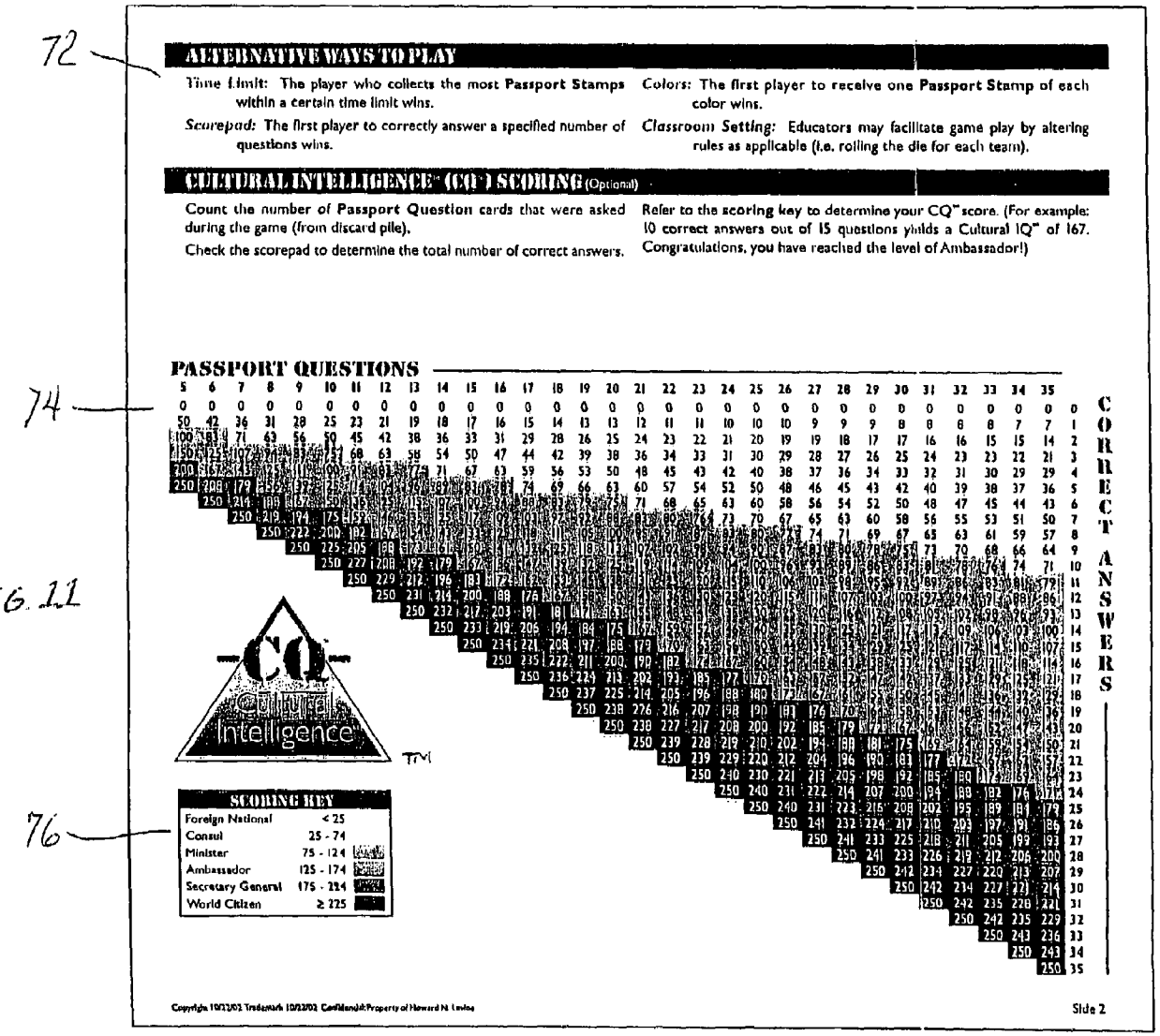
FIG. 11 is an elevational view of the preferred embodiment of additional instructions and the Cultural Intelligence™ chart of the culture and geography based game of the instant invention.

Referring to the figures, the system of the game 10 generally comprises a game board 12, passport cards 20, game pieces/pawns 24, question cards 30, culture cards 40, answer cards 50, stamps 23, and scorecard 60. The game 10 also includes preferred and alternative instructions 70 and 72 and a Cultural Intelligence™ scoring chart 74, as shown in FIGS. 10 and 11, respectively, and may also include a six-sided die. With reference to FIG. 1, the game board 12 includes a world map of the continents 14 and two or more intersecting closed-loop paths 13 superimposed over the continents. The paths 13 form a plurality of intersections 17. The paths 13 are formed by question spaces 15, Culture Card™ spaces 18 and airport spaces 16, which are shown as circles but may comprise other geometric shapes. The question spaces 15 indicate that a question card 30 is to be drawn by a player landing on these spaces. The Culture Card™ spaces 18 indicate that a Culture Card™ card 40 is to be drawn by the player when landing on it. The airport spaces 16 indicate that a player landing on it may travel or move their playing piece 24 to any other airport space 16 on the game board 12. The question and culture spaces, 15 and 18 respectively, each preferably have two colors, which are used to indicate which colored stamps a player has to choose from when answering a question correctly from a question card 15 or when a Culture Card™ 18 indicates that the player may get a stamp. The colors used for the spaces 15, 18 coincide with the colored stamps shown in FIG. 8 and may also coincide with the colors used for the passport cards 20 and continents. A player uses the die to determine the number of spaces to move based on the number rolled.

With reference to FIG. 3, the game 10 comprises a plurality of game pieces or pawns 24. The pawns 24 each comprise a predetermined unique color, slotted base 28 and insert 26. The insert 26 slides into the slotted base 28, which secures the insert 26 therein. Each pawn 24 preferably has a unique color for identification purposes. The color of the pawns 24 and passport cards 20 preferably coincide, wherein each pawn 24 has a matching passport 20 based on color to ensure that the proper passports are stamped. The inserts 26 and, or slotted bases 28 may include the color indicia. The inserts 26 include indicia of various world landmarks on at least one side and preferably on both sides.

Figure 7:
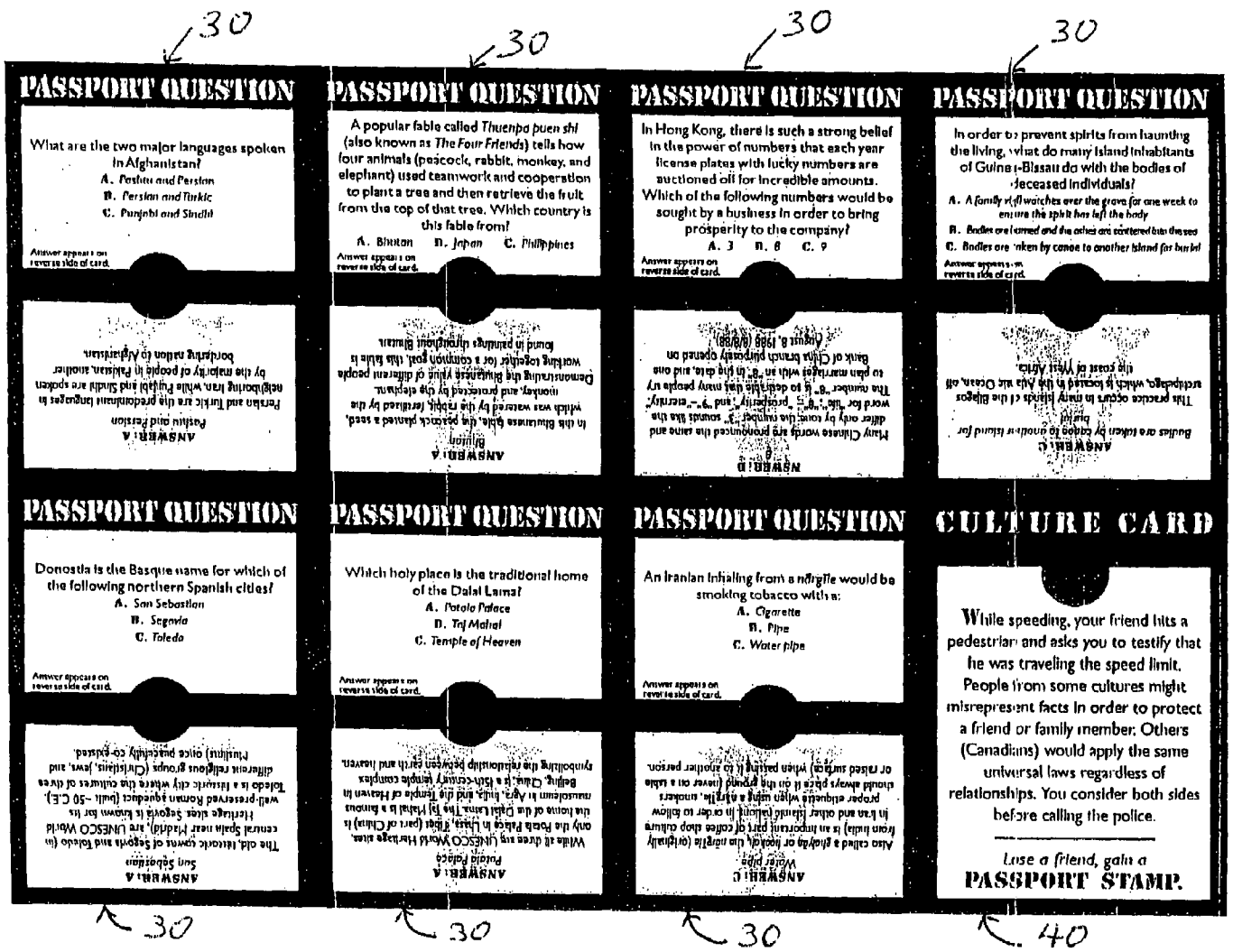
FIG. 7 is an elevational view of the preferred embodiment of other passport question cards and cultural situation based cards in accordance with the instant invention.

With reference to FIGS. 6 and 7, the Culture Cards™ 18 comprise cultural situation based cards 18. The cards 18 comprise a substrate that may be made from paper, cardboard, or plastic based material. At least one and preferably two cultural situations with instructions to the player are printed, embossed or applied to the cards 18 with techniques and materials known in the art. In a computer or other processor-based version, the cards 18 comprise a visual image with the questions and answers appearing thereon. Each cultural situation based card 18 conveys a different hypothetical situation with a corresponding response in some identified geographic region and instructs the player to collect a passport stamp, forfeit one passport stamp, or do or win nothing. The cultural situation based cards 18 preferably use the hypothetical situations to teach the players about various world customs and cultures. The cultural situation based cards 18 preferably have a hypothetical situation and response displayed on each side. The game 10 has approximately thirty cultural based cards 18, but may have more or less.

With reference to FIGS. 5 and 7, the question cards 30 preferably include and visually convey a question 32 and answer 34 with additional facts 35 on one side and the corresponding answer 34 with facts 35 and question 32, respectively, on the opposite side. The additional facts 35 provide interesting information and may also give clues or answers to other questions 32. The question card 30 comprise a substrate that may be made from paper, cardboard, or plastic based material. The questions 32 and answers 34 may be printed, embossed or applied to the cards with techniques and materials known in the art. In a computer or other processor-based version, the cards 30 comprise a visual image with the questions and answers appearing thereon. The questions 32 are directed to various world cultures and geographies, including questions on various world customs, geographic facts, or other information particular to a given country or region. Each answer 34 preferably includes three options denoted "A," "B" and "C." The number of questions 32 and answers 34 per card 30 may vary.

The answer cards 50, as shown in FIG. 4, are marked with an answer designation 54, which preferably comprises an "A," "B" or "C" on one side and a marking 52 on the other side to identify the card as an answer card 50. Although the game 10 provides three choices per question, the number of answer options may vary. The number of answer cards 50 and answer designations 54 coincide with the number answer options. The cards 50 comprise a substrate that may be made from paper, cardboard, or plastic based material. The answer designations 54 may be printed, embossed or applied to the cards with techniques and materials known in the art. In a computer or other processor-based version, the answer cards 50 comprise a visual image with the answer designations 54 appearing thereon. Each player is given answer cards 50, one of each, at the beginning of the game to use for answering questions. When a player draws a question card 30, every player answers the question by selecting either an "A," "B" or "C" answer card 50 to denote their answer choice. The game 10 has approximately 750 question cards 30, but may have more or less.

Figure 2:
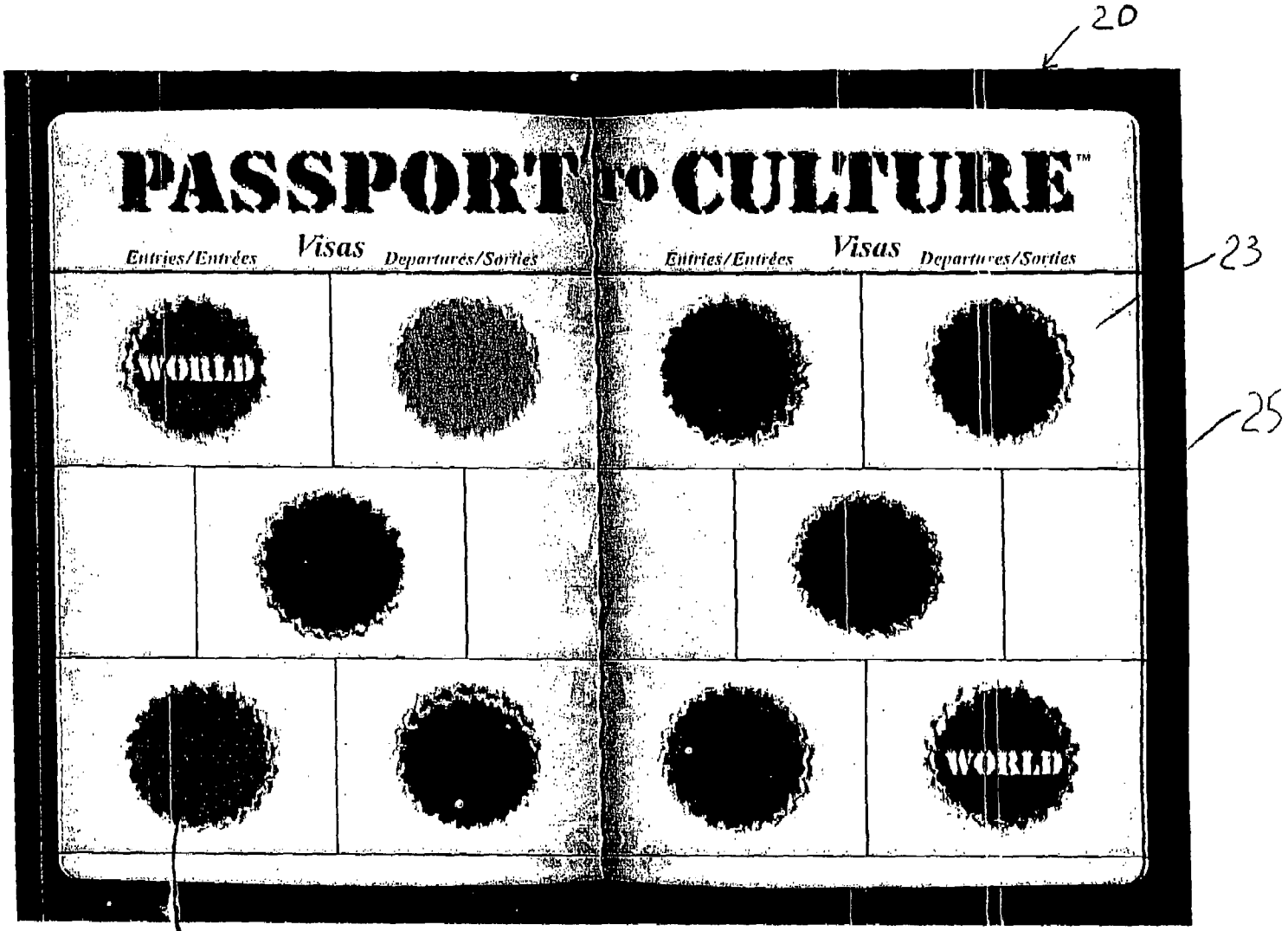
FIG. 2 is a plan view of the preferred embodiment of the passport card in accordance with the instant invention.
Figure 8:
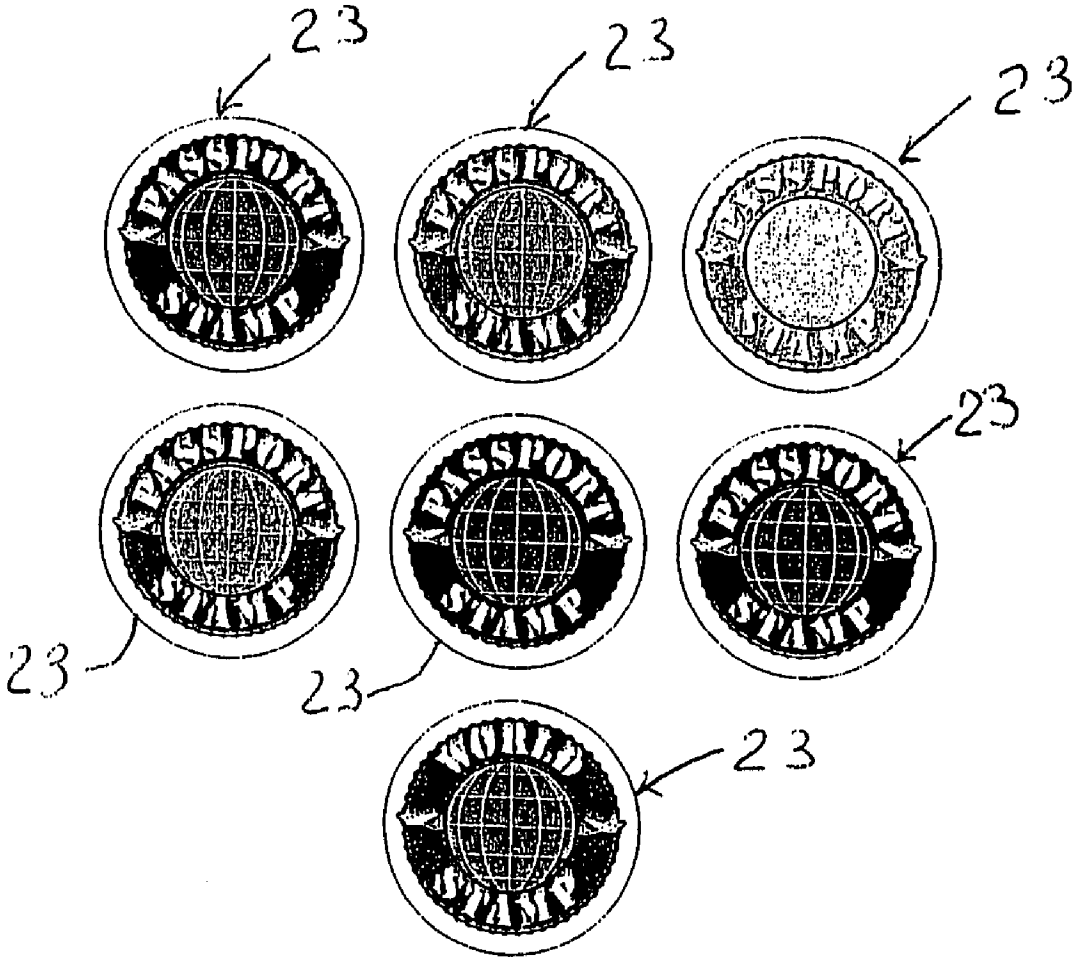
FIG. 8 is an elevational view of the preferred embodiment of the stamps in accordance with the instant invention.

With reference to FIG. 2, the game 10 has a plurality of passport cards 20. Each passport card 20 has unique color indicia 25 for identification purposes, which preferably matches a similarly colored game pawn 24 to ensure that the proper card is stamped. The color indicia 25 is also used for indicating each players starting position on the game board 12. Each passport card 20 is partitioned with a predetermined number of sections 21, such as ten. Each section 21 is marked with a color-coded stamp designation 22 or a "World" marking designation. With reference to FIG. 8, the game 10 comprises a plurality of different colored stamps 23. The colors and number of stamps 23 coincide with the stamp designation 21 colors and numbers. When a player answers a question correctly or is directed to receive a stamp 23, the stamp 23 is applied to the section having the stamp designation 22 corresponding to the color of the question space. A player preferably has two color options as dictated by the colors on or around the question spaces 15. With reference to FIG. 2, the "World" stamp designation 22 comprises a wildcard, wherein a player may choose to apply a stamp 23 there if they already received the stamps 23 corresponding to the color options available. The game 10 preferably includes two "World" stamp designations 22. In the preferred embodiment of the method of the game 10, each designation 22 may only be stamped once. In the preferred embodiment, the first player to stamp all designations 22 wins.

Figure 9:
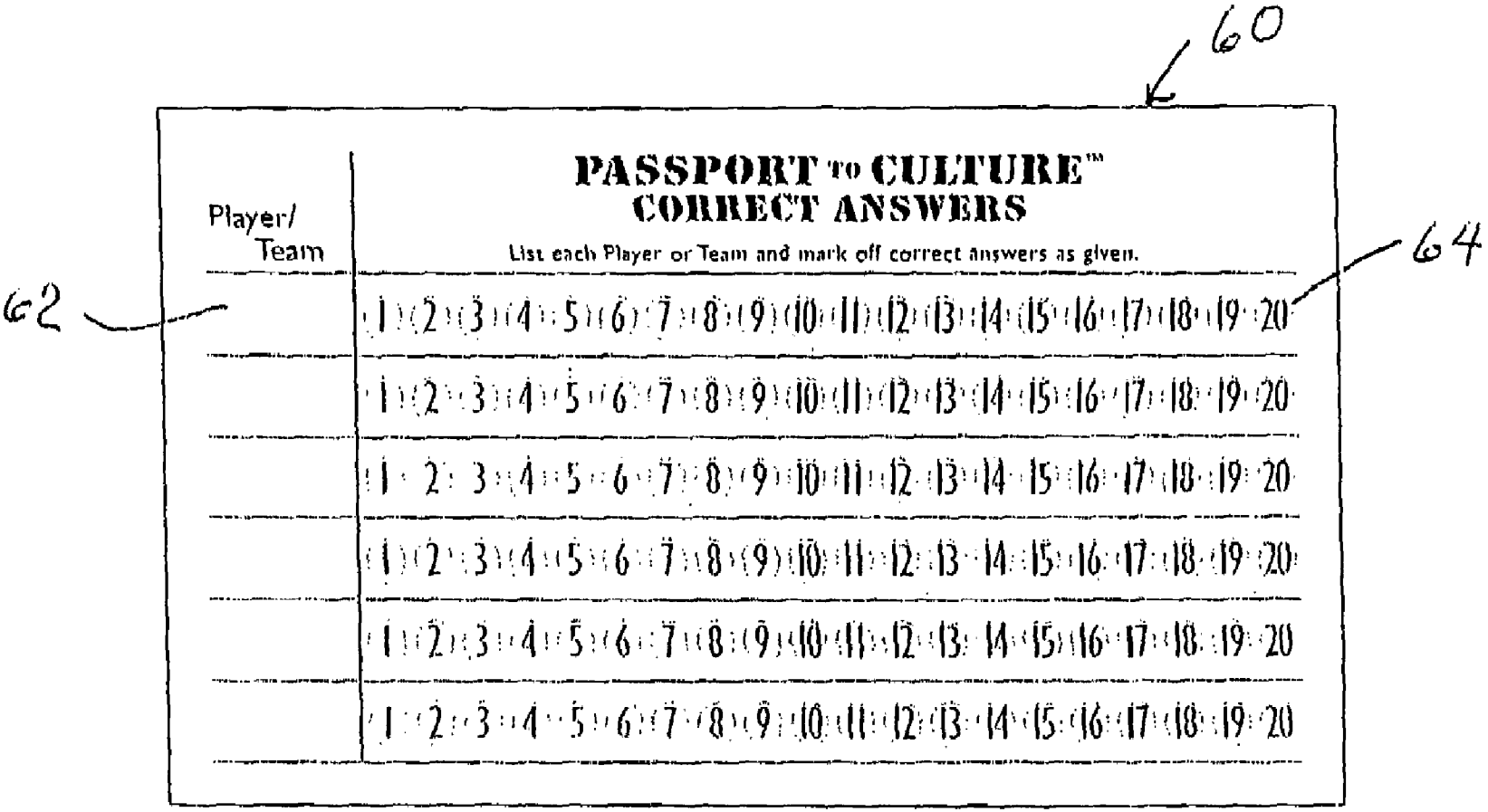
FIG. 9 is an elevational view of the preferred embodiment of the scorecard in accordance with the instant invention.

With reference to FIG. 9, the game 10 comprises a plurality of scorecards 60 for keeping score during a game. The scorecard 60 comprises a plurality of spaces 62 for entering the names of the players and the numbers "1" to "20" next to each name space 62. The exact numbers used may vary. Each time a player answers a question correctly, the number 64 corresponding to the number of questions answered correctly up to that point in the game is checked or marked. In one embodiment, the first player to correctly answer the required number of questions and stamp all designations 22 wins. In another embodiment, a CQ™ score may be determined and factored into determining the winner. For instance, if a first player is the first to fill its passport card 20 but has a lower CQ™ then a second player that is the second to fill its passport card 20, the first player may be required to make up the difference by obtaining a predetermined number of additional stamps before the second player collects all its stamps.

With reference to FIG. 11, the game 10 includes a "Cultural Intelligence™" ("CQ™") scoring chart for determining a players "CQ™" and a scoring key 76 for ascertaining a player's CQ™ ranking. The chart 74 has a plurality of columns designating the number of Passport Questions™ asked and a plurality of rows designating the number of questions correctly answered. To determine a player's CQ™, identify the number of questions asked and the number of correct answers given and then find where those numbers intersect on the chart 74. That number comprises the player's CQ™. The scoring key 76 includes a plurality of designations corresponding to CQ™ score ranges. The designations include foreign national, consul, minister, ambassador, secretary general and world citizen. A foreign national has a CQ™ score less than 25. A consul has a CQ™ score in the range of 25–74. A minister has a CQ™ score in the range of 75–124. An ambassador has a CQ™ score in the range of 125–174. A secretary general has a CQ™ score in the range of 175–224. A world citizen has a CQ™ score in the range of 225 or higher.

In the preferred embodiment, the object of the game is to be the first player to collect a predetermined number of stamps 23 on its passport card 20, such as ten, and, or to obtain the highest CQ™ score. Before starting the game 10, the game board 12 is set up, the question cards 30 and answer cards 50 are separately shuffled and placed face down in separate piles, and each player selects a passport card 20 and color matching pawn 24, receives a complete set of answer cards (e.g. "A," "B" or "C") and positions their pawn 24 at the airport space 16 corresponding to the color of the pawn 24. The players also select one player to record correct answers on the score pad 60.

To start the game, the player whose birthday is next during the current calendar year goes first by rolling the die and moving their pawn 24 the number of succeeding spaces shown on the die. Other methods may be employed for determining who goes first. Going clockwise, each player takes their turn in order and rolls the die to determine the number of spaces to move their pawn 24 for that turn. If a player reaches any of the intersection points 17, they have the option of following any of the paths intersecting the intersection point 17. A rolling tray may be used to avoid influencing the roll. After moving to the appropriate space 15, 16 or 18, the player determines whether the space is a question space 15, Culture Space™ 18, or airport space 16.

If a player lands on a question space 15, the player draws the top or next question card 30 and reads a question from the card 30. All players answer the question by considering the answer options on the card, which are denoted by A, B or C indicia, and then placing either an "A," "B" or "C" answer card face down to identify their answer choice. After all answer selections are made, the answer 34 and follow-up facts 35 are read aloud from the back of the card 30. The players reveal their answer by turning over their selected answer card 50 after the answer 34 is read. Alternatively, the answer 34 may be read after the players reveal their selected answer so no can change their answer. All players that answer correctly earn a stamp 23 corresponding to a color on the space 15 on which the current player landed. A space 15 may have one or more colors. If a space 15 has more than one color, then any stamp 23 corresponding in color may be selected. If a player's passport card 20 is already stamped with the available colors, it may elect to receive a stamp on the "World Stamp™" designation 22. If a player already has all "World Stamp™" designations 22 and the current available colors stamped on their passport card 20, then the player does not receive any stamps 23. At the end of each turn, the designated scorer marks the score pad 60 to record a point for each player that gave a correct answer and the question card 30 is placed in a discard pile or at the bottom of the question card pile.

If a player lands on a Culture Card™ space 18, the player draws the next Culture Card™ and reads it aloud to share the educational information thereon and to identify any instructions. Unlike the question cards 30, the Culture Cards™ 40 only apply to the player that landed on the space 18. The instructions 44 on the Culture Cards™ 40 preferably include either awarding or not awarding a stamp 23. The instructions 44 may also provide clues, instruct the player to move to another space, or inform the player that they lose their next turn.

When a player lands on an airport space 16 after a roll, the player may choose to stay on the current airport space 16 or "fly" directly to any other airport space 16. This gives the player an opportunity to travel to another continent that they have not reached yet to work towards obtaining any missing stamps. After this selection is made, the player draws and reads the next question card 30 and everyone answers as described in the above paragraphs.

In the preferred embodiment, the first player to collect all the stamps 23 that complete their passport card 30 wins. The player having the highest CQ™ may also share top honors, if decided by the players before the game. Alternatively, a player can win by collecting the most stamps 23 in a pre-specified time limit. In another embodiment, the first player to correctly answer a specified number of questions can win. In a different embodiment, a player could win by being the first player to receive a stamp 23 of each color.

In another alternative embodiment, the first player to complete their passport card 20 while having the highest CQ™ may be deemed the winner. In this embodiment, if a player completes their passport card 20 first but doesn't have the current highest CQ™, then they continue to play until they reach the highest CQ™ or until another player becomes the first to complete their passport 20 while holding the highest CQ™.

An example of the game follows. A player rolls a five and moves their pawn 24 five spaces landing on a blue/orange space 15. The player selects the next question card 30 and reads the question and answer options 32 aloud. All the players choose an answer by placing an A, B or C answer card 50 face down in front of them. Once everyone makes a selection, the current player reads the answer 34 and follow-up facts aloud. The players then reveal their answer card 50. All players that answered correctly receive either a blue or orange stamp 23. If the player already collected the blue and orange stamps 23, they may receive a World Stamp™. If they also have all their World Stamps™ then no stamp 23 is awarded. The designated score keeper marks the scorecard 60 for all players giving correct answers. The question card 30 is then placed in a discard pile for later CQ™ scoring.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A world culture game, said game comprising:

a game board having indicia, said indicia comprising a world map including a plurality of continents and at least two intersecting paths comprising a plurality of spaces traversing said continents;

a plurality of said plurality of spaces comprising indicia having either question indicia for indicating the drawing of at least one of said question cards, airport indicia for indicating the option to travel to other of said continents, or culture indicia for indicating the drawing of at least one of said culture cards;

a plurality of passport cards;

a plurality of game pieces;

plurality of question cards each having question indicia thereon comprising different questions;

plurality of culture cards each having culture indicia thereon comprising hypothetical cultural situations and corresponding instructions;

plurality of answer cards having indicia thereon for indicating a players answer choice responsive to a question on at least one of said question cards; and passport stamp means for stamping said passport cards based on satisfied conditions.

2. A game as recited in claim 1, further comprising:

scoring chart for indicating scores commensurate with a players knowledge on culture and, or geography.

3. A game as recited in claim 1, further comprising:

at least one scoring pad to allow at least one player to log and track their score.

4. A game as recited in claim 1, further comprising at least one die with six sides.

5. A game as recited in claim 1, wherein said game board comprises a plurality of different continents each comprising a different color code.

6. A game as recited in claim 1, wherein each of said passports comprises a different color code.

7. A game as recited in claim 1, wherein each of said game pieces comprises a different color code wherein said color code of each game piece coincides with said color code for said passports.

8. A game as recited in claim 1, wherein said answer cards comprises:

at least one card with a first answer choice indicia;

at least one card with a second answer choice indicia; and at least one card with a third answer choice indicia.

9. A game as recited in claim 1, wherein said spaces comprise:

at least two different colors that are used to determine the correct colored stamp to use when a player answers a question correctly.

10. A game as recited in claim 1, wherein said passport comprises structure adapted for collecting stamps when a player answers a question correctly.

11. A game as recited in claim 1, wherein said stamp means comprises a plurality of different colored stamps coinciding with the colors of the said spaces.

12. A game as recited in claim 1, wherein said plurality of spaces further comprises:

at least two airport spaces having airport indicia for indicating that a player may move to one of said other airport spaces.

13. A game as recited in claim 1, wherein said at least one path comprises:

at least two intersecting paths.

* * * * *